US008869862B2

(12) United States Patent
Erhart et al.

(10) Patent No.: US 8,869,862 B2
(45) Date of Patent: Oct. 28, 2014

(54) LABELLING MACHINE

(75) Inventors: Georg Erhart, Kirchroth (DE); Stefano Grassi, Castellucchio (IT); Antonella Prandi, legal representative, Castellucchio (IT)

(73) Assignee: Kosme S.R.L., Roverbella (IT)

( * ) Notice: Subject to any disclaimer, the term of this patent is extended or adjusted under 35 U.S.C. 154(b) by 359 days.

(21) Appl. No.: 13/391,163

(22) PCT Filed: Sep. 4, 2009

(86) PCT No.: PCT/IT2009/000398

§ 371 (c)(1),
(2), (4) Date: May 11, 2012

(87) PCT Pub. No.: WO2011/027372

PCT Pub. Date: Mar. 10, 2011

(65) Prior Publication Data

US 2013/0192766 A1 Aug. 1, 2013

(51) Int. Cl.
*B65C 9/00* (2006.01)
*B65C 9/40* (2006.01)

(52) U.S. Cl.
USPC ..... 156/542; 156/567

(58) Field of Classification Search
USPC ..... 156/542, 567, 568
See application file for complete search history.

(56) References Cited

U.S. PATENT DOCUMENTS

| | | | | |
|---|---|---|---|---|
| 4,362,594 | A | 12/1982 | Nagano et al. | |
| 4,531,995 | A | 7/1985 | Gau | |
| 7,637,052 | B2 | 12/2009 | Siedlaczek | |
| 8,052,814 | B2 | 11/2011 | Kellhammer et al. | |
| 8,267,142 | B2 * | 9/2012 | Ferri et al. | 156/567 |
| 2004/0099379 | A1 | 5/2004 | Erich | |
| 2005/0153427 | A1 | 7/2005 | Eder et al. | |
| 2006/0265947 | A1 | 11/2006 | Siedlaczek | |
| 2008/0156442 | A1 * | 7/2008 | Meinzinger | 156/351 |
| 2009/0294070 | A1 * | 12/2009 | Kellhammer et al. | 156/365 |

FOREIGN PATENT DOCUMENTS

| | | | |
|---|---|---|---|
| DE | 10 2005 041531 | A1 | 3/2007 |
| GB | 2138388 | A | 10/1984 |
| JP | 2007238160 | A | 9/2007 |
| JP | 2009001986 | A | 1/2009 |
| WO | 2005011363 | A1 | 2/2005 |

* cited by examiner

*Primary Examiner* — Mark A Osele
(74) *Attorney, Agent, or Firm* — Pearne & Gordon LLP

(57) ABSTRACT

A labelling machine comprises a main supporting frame (2) on which a carrousel (6) is mounted, the carrousel being equipped with supporting means for the objects to be labelled. A plurality of labelling devices (12) is positioned radially along the edge of the carrousel (6) for applying labels to objects placed on the carrousel (6). The main supporting frame (2) has a guiding and supporting track (17) to which the labelling devices (12) are slidably connected so that they can be placed at different positions along the edge of the carrousel (6). The machine also comprises a plurality of connecting modules (26) equipped with first coupling means (27) allowing sliding coupling to the track (17), and second coupling means (28) for reversibly coupling each labelling device (12) to a connecting module (26).

24 Claims, 9 Drawing Sheets

LABELLING MACHINE

TECHNICAL FIELD

This invention relates to a labelling machine of the type intended for applying a plurality of labels on a single product such as a bottle or another container. A typical example of use of this type of labelling machine is for labelling bottles of wine when labels have to be applied on the front, the back, on the neck, etc.

BACKGROUND ART

In general, this type of machine comprises a rotary carrousel, equipped with a plurality of supporting plates for the product to be labelled. The carrousel rotates about its own axis so that each product can be brought one after another to a plurality of labelling devices positioned along the edge of the carrousel and each designed to apply one or more labels to the product. Depending on the shape and type of label to be applied, the labelling devices have different structures.

Moreover, to guarantee correct application of each label, the supporting plates are advantageously able to rotate in a controlled fashion about their own axes. An electronic control (usually also known as an "electronic cam") coordinates the movement of the carrousel, the plates and the labelling devices.

However, to guarantee correct machine operation, depending on the shape and size of the product to be labelled, the labelling devices must be located at predetermined angular positions around the edge of the carrousel. But such positions are not incompatible with labelling products of different shapes and sizes. Depending on the sizes and shapes of the bottles and the labels, the distance between one device and another must be adjusted to allow correct application.

Consequently, this type of labelling machine is not very versatile. Therefore, both the purchase and operating costs are relatively high compared to productivity.

According to the prior art, the most widespread solution for increasing the versatility of machines is to over-equip them in terms of the number of labelling devices, fitting the same machine with two or more identical devices (which apply the same type of label) at two or more different positions along the edge of the carrousel. On each occasion, depending on the type of product to be labelled, only some of the devices are used.

As can immediately be seen, said solution is extremely expensive both because it requires the purchase of two or more identical devices which will only be used alternately, and because it also requires oversizing of the machine as regards the diameter of the carrousel. But larger dimensions imply bigger purchase costs and more space occupied at the company premises.

In most of the machines currently used, the possible positions for the labelling devices along the edge of the carrousel are limited because they correspond to the centres of the sides of a polygonal structure surrounding the carrousel.

Some alternative solutions are described in patents WO 2005/011363, U.S. Pat. No. 4,362,594 and GB 2 138 388 which all allow labelling devices to be mounted at any angular position relative to the carrousel. In said patents, the labelling devices are rigidly fixed to a circular supporting track surrounding the carrousel.

Said solution, although allowing greater positioning variety, also has disadvantages, in particular relative to the need for size change-overs (that is to say, changes in the type of product to be labelled). With each size change-over each labelling device would have to be moved to clearly defined predetermined positions, disconnecting it from the body of the machine. In reality, said operation is very complicated given the weight and size of the labelling devices.

DISCLOSURE OF THE INVENTION

In this situation the technical purpose which forms the basis of this invention is to provide a labelling machine which overcomes the above-mentioned disadvantages.

The technical purpose of this invention is also to provide a labelling machine which allows size change-overs to be performed very rapidly and precisely.

In particular, this invention has for a technical purpose to provide a labelling machine which guarantees great versatility for a relatively low cost.

The technical purpose specified and the aims indicated are substantially achieved by a labelling machine as described in the appended claims.

BRIEF DESCRIPTION OF THE DRAWINGS

Further features and the advantages of this invention are more apparent in the detailed description, with reference to the accompanying drawings which illustrate several preferred, non-limiting embodiments of a labelling machine, in which.

DETAILED DESCRIPTION OF THE PREFERRED EMBODIMENTS OF THE INVENTION

With reference to the accompanying drawings the numeral 1 denotes as a whole a labelling machine made in accordance with this invention.

Figure 2:
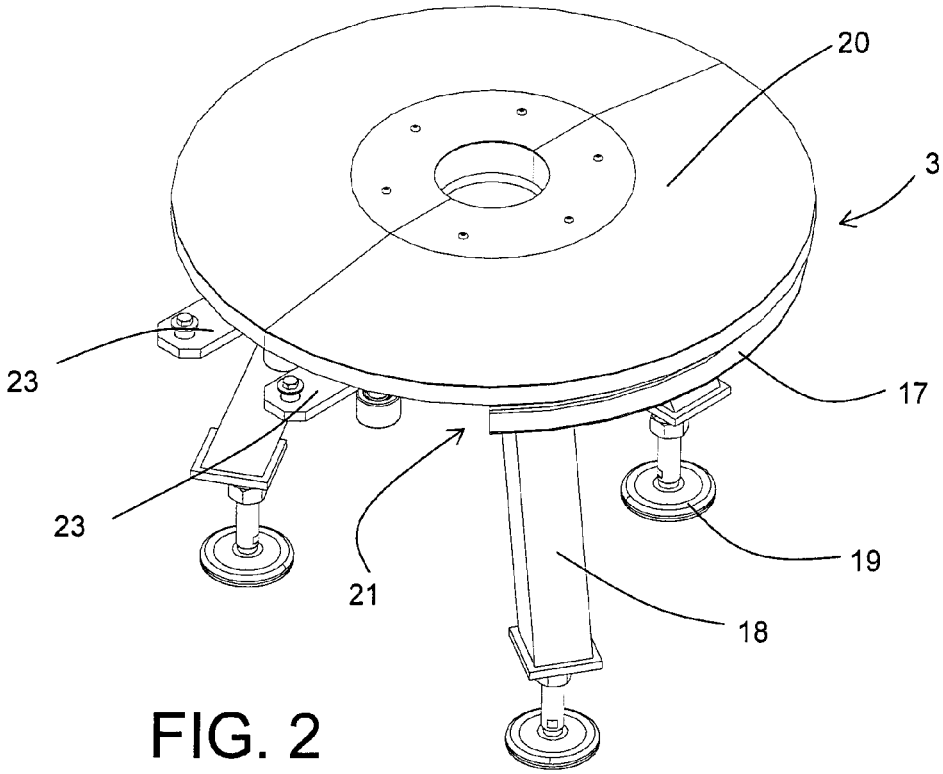
FIG. 2 is an axonometric view of a main supporting frame of the machine of FIG. 1.

The labelling machine comprises first a main supporting frame 2 which in the embodiment illustrated has a table-shaped lower parts 3 (FIG. 2). In the known way, the main supporting frame 2 illustrated also comprises supporting columns 4 and an upper portion 5 located at a predetermined height above the table-shaped part.

On the main supporting frame 2, between the lower part 3 and the upper portion 5, a carrousel 6 is rotatably mounted so that it can rotate about a vertical axis of rotation. Carrousel 6 rotation is controlled by a main motor 7 located above the upper portion 5 of the main supporting frame 2. The outside of the carrousel 6 is equipped with a plurality of supporting means for objects to be labelled. The accompanying drawings only show the lower plates 8 of the supporting means. In plan view, the part of the carrousel 6 supporting the plates 8 is circular and the plates 8 are evenly spaced out close to its outer edge.

Figure 1:
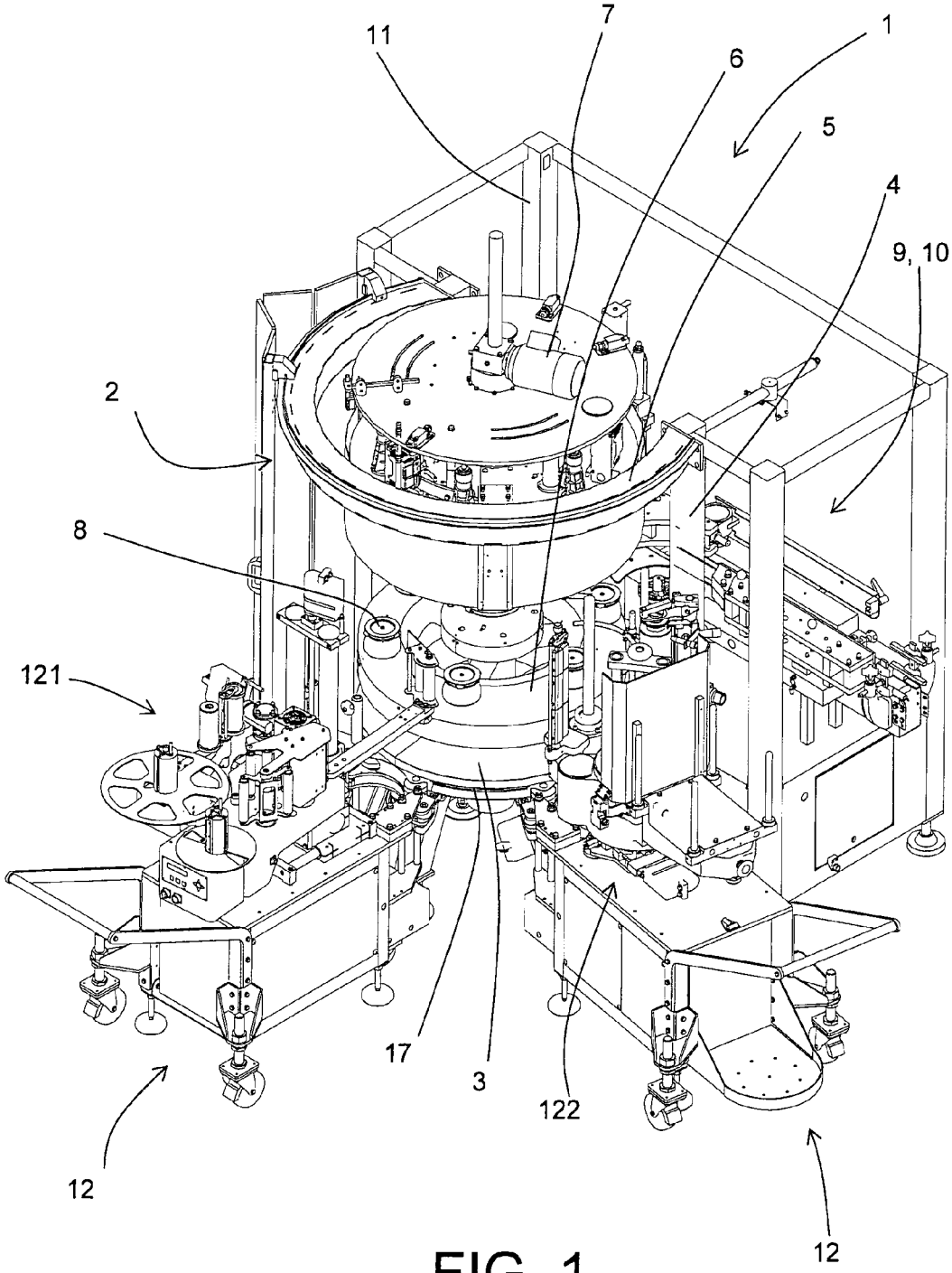
FIG. 1 is an axonometric view of a labelling machine made according to the present invention.

In the known way, therefore not described in detail, the machine 1 also comprises means 9 for feeding the objects to be labelled to the supporting means, and means 10 for picking up the labelled objects from the supporting means. In the embodiment illustrated the feed means 9 and the supporting means are supported in a containment structure 11 having an overall parallelepiped shape (FIG. 1) and they comprise screw feeder and star-wheel transfer mechanisms (of the known kind).

The machine also comprises a plurality of labelling devices 12 positioned radially along the edge of the carrousel 6 which in practice apply labels to objects placed on the supporting means which pass them during carrousel 6 rotation. The embodiments illustrated show, by way of example, a device 121 for applying adhesive labels and a cold glue application device 122.

In the embodiment illustrated, the labelling devices 12 advantageously comprise a secondary supporting frame 13, the bottom of which is fitted with wheels 14 and parking feet 15. The wheels 14 and/or the feet 15 can also be adjusted vertically, allowing the operator to choose whether to rest the wheels or the feet on the ground, thus adjusting the height of the labelling device 12 relative to the ground, if necessary. To allow the device 12 to be moved when the wheels 14 are resting on the ground, the devices 12 illustrated also comprise a movement bar 16 which can be gripped by an operator. Otherwise, since the structure of the labelling devices 12 is of the known type, it is not described in further detail herein.

The labelling devices 12 are slidably connected to a guiding and supporting track 17 belonging to the main frame 2, so that they can be placed at different angular positions along the edge of the carrousel 6.

Figure 3:
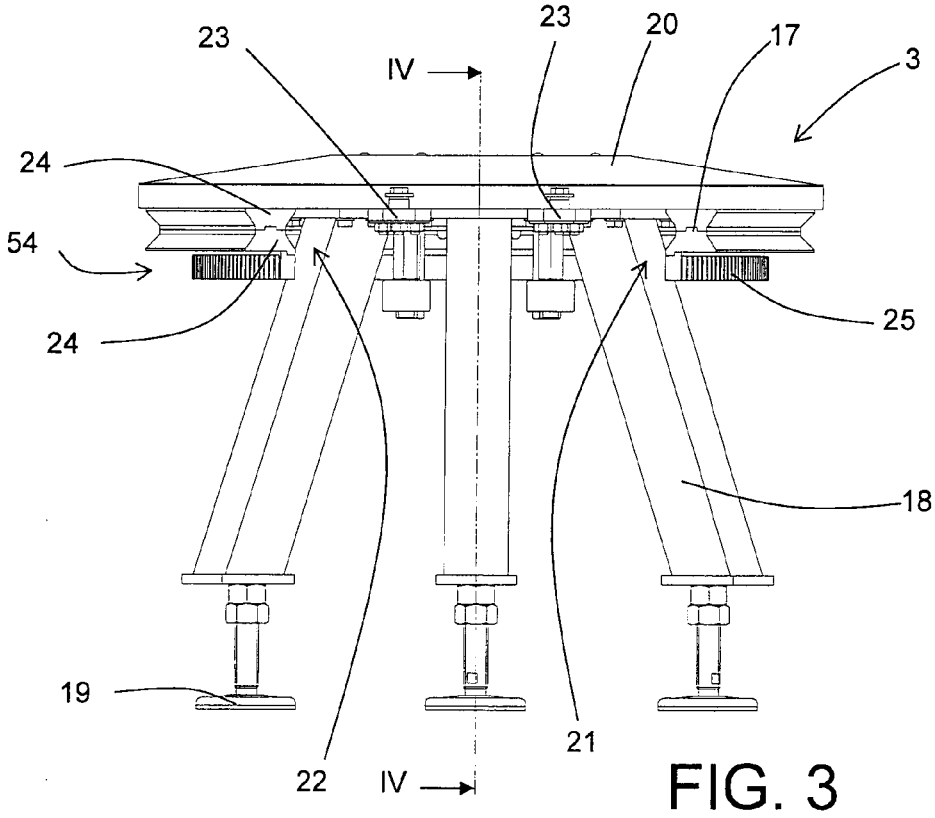
FIG. 3 is a front elevation view of the main supporting frame of FIG. 2.
Figure 4:
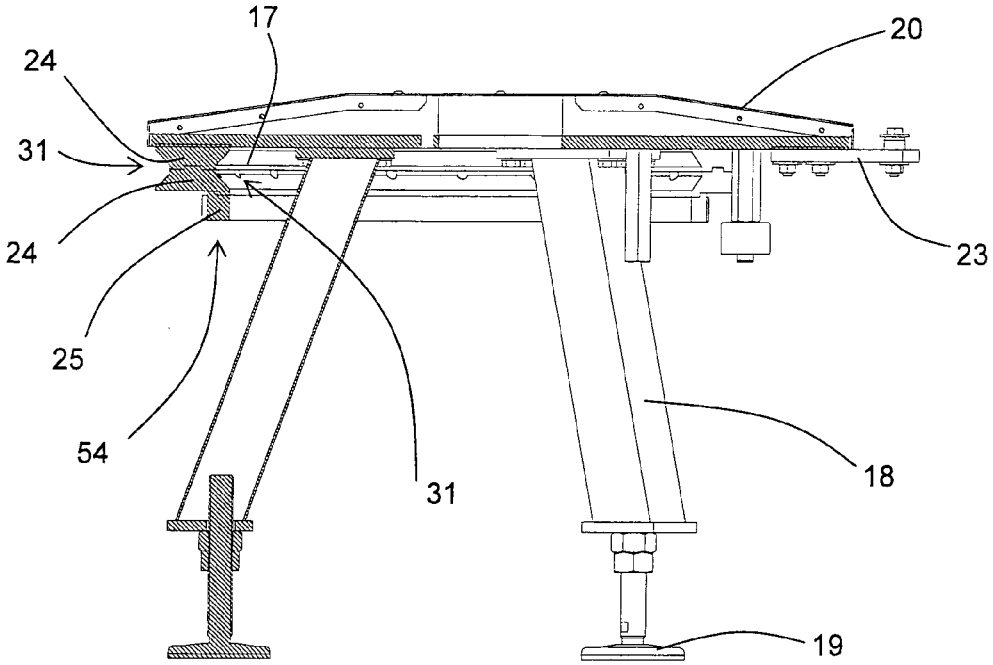
FIG. 4 is a cross-section of the main supporting frame of FIG. 3 along the line IV-IV.
Figure 5:
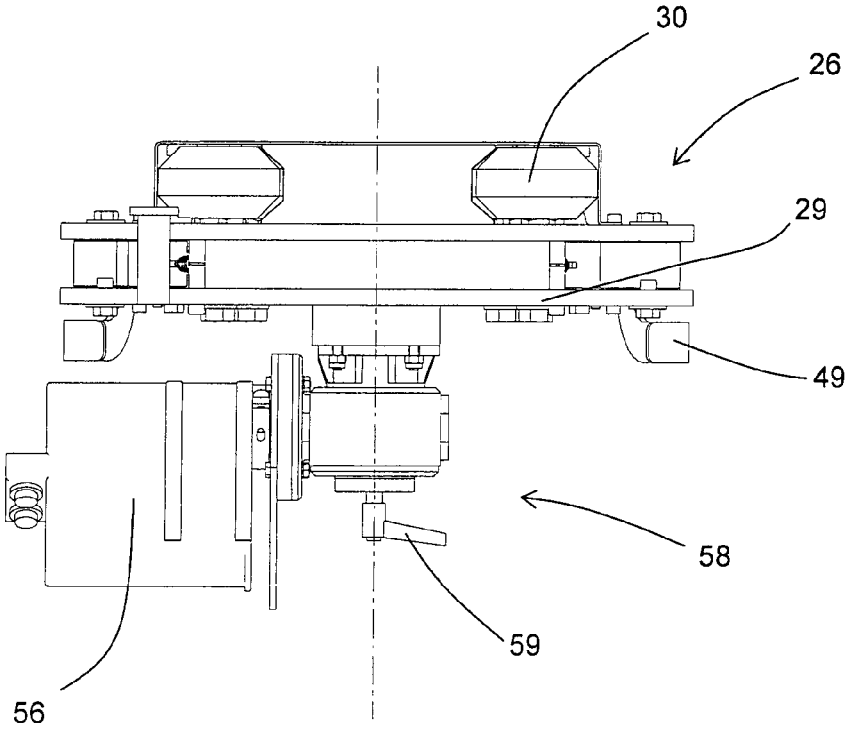
FIG. 5 is a front elevation view of a first embodiment of a connecting module which is part of a labelling machine according to the present invention.
Figure 6:
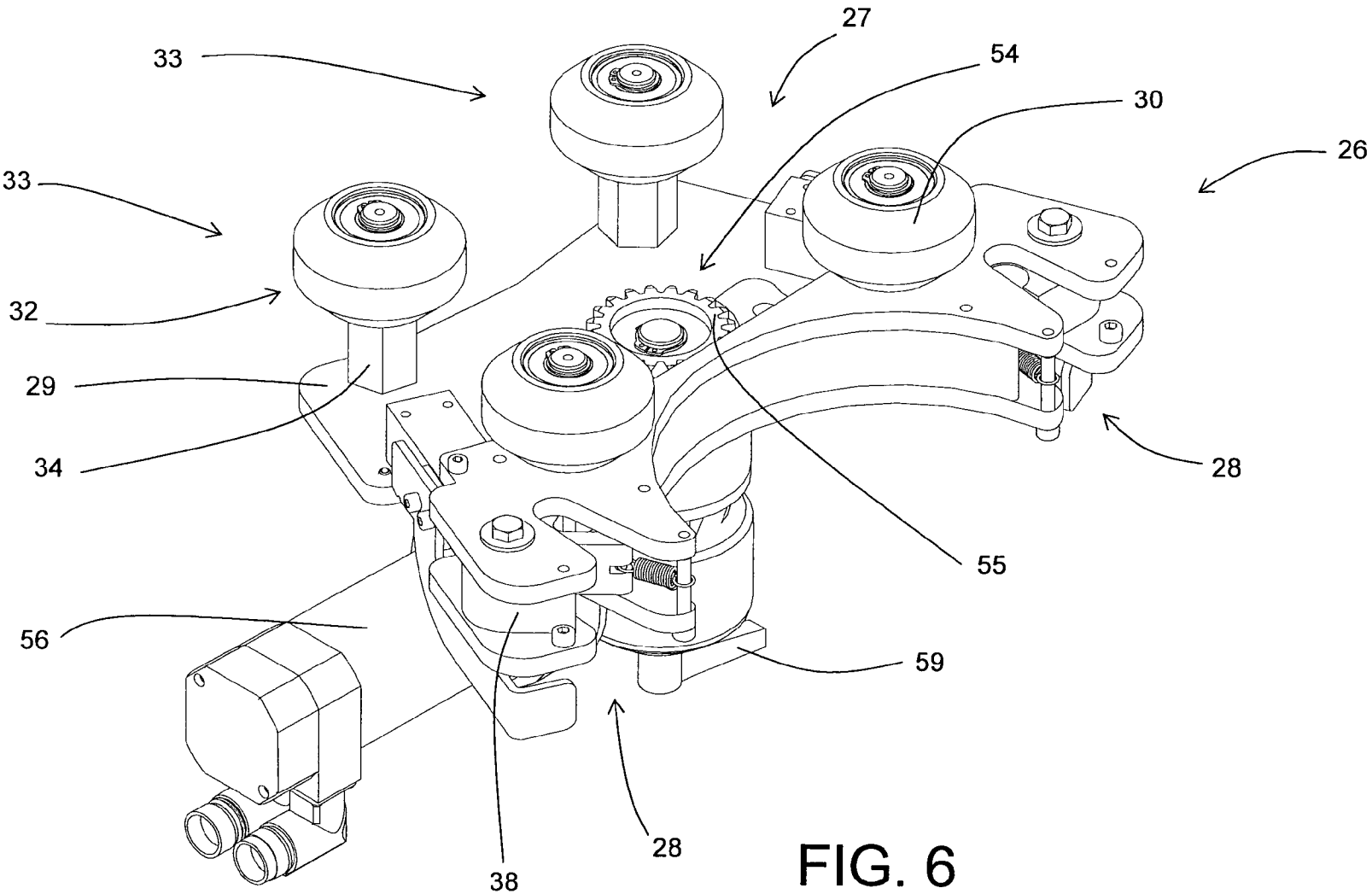
FIG. 6 is an axonometric view of the connecting module of FIG. 5.
Figure 7:
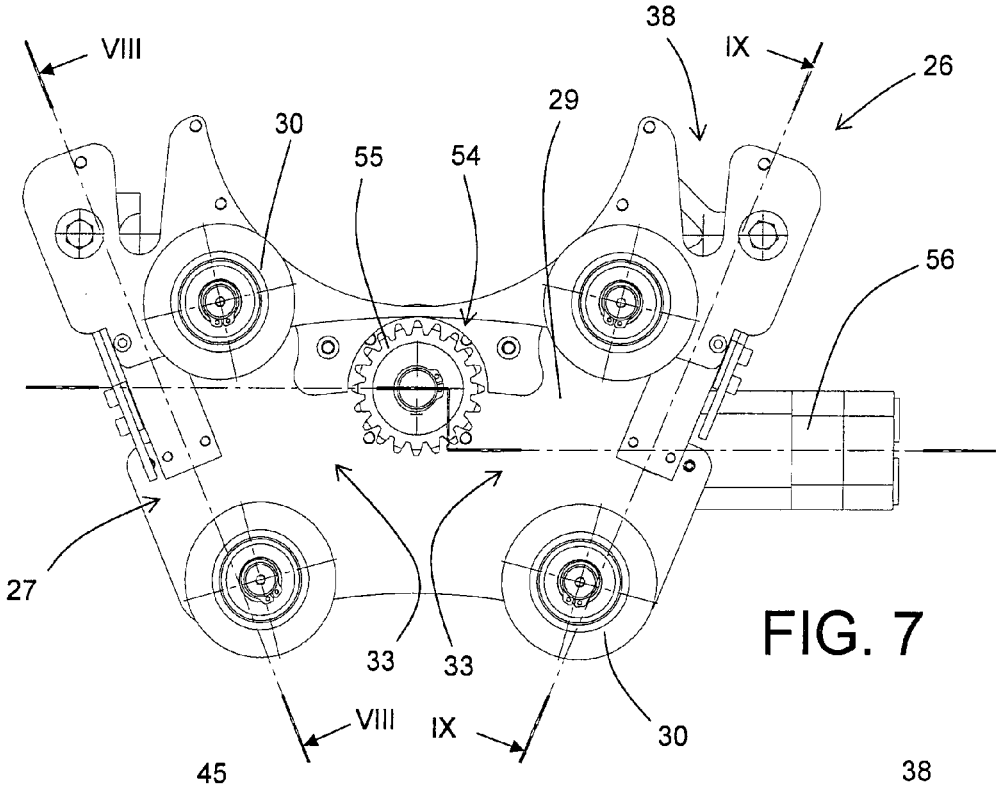
FIG. 7 is a top view of the module of FIG. 6.
Figure 8:
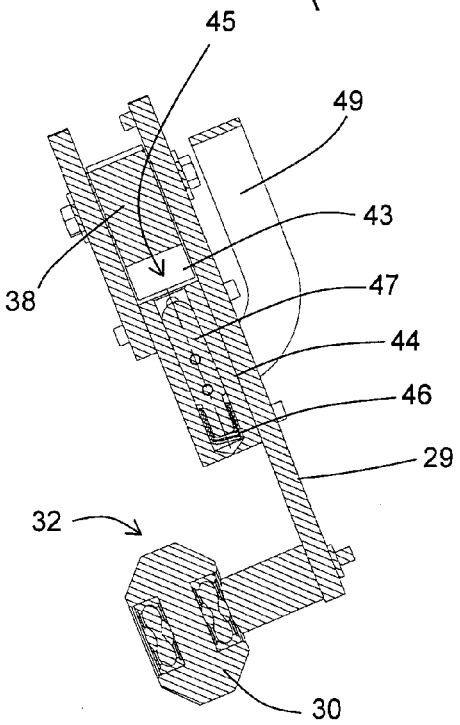
FIG. 8 shows the module of FIG. 7 along the line VIII-VIII.
Figure 9:
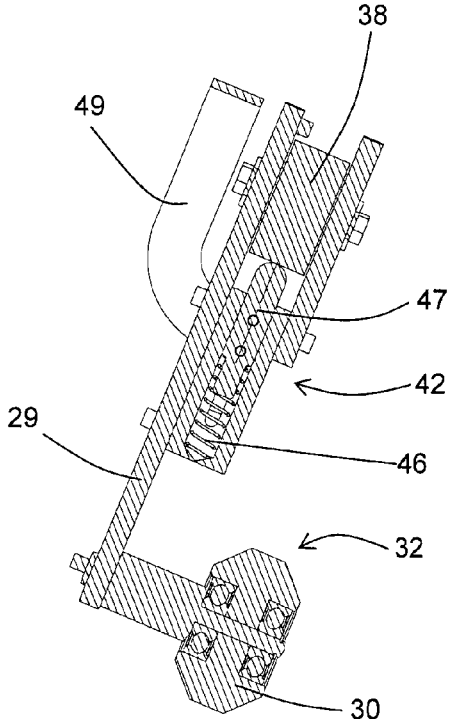
FIG. 9 shows the module of FIG. 7 along the line IX-IX.

The lower part 3 of the main supporting frame 2, shown in FIGS. 2 to 4, comprises three legs 18 with adjustable feet 19 which support a supporting surface 20 having a shape slightly resembling a truncated cone and pierced at the centre (for rotatably supporting the carrousel 6), below which the track 17 is fixed. The track extends along approximately three quarters of the edge of the supporting surface 20, between a track first end 21 and a second end 22. At the zone between the first end 21 and the second end 22 of the track 17, the frame also comprises two radial brackets 23 used for connecting the feed means 9 and the pickup means 10. The track 17 comprises two elements 24, shaped in such a way that they have a trapezoidal cross-section at the first approximation, and connected in such a way that they are opposite, giving the lateral surfaces of the track 17 a concave shape. Applied below the track 17 there is a rack 25 having the shape of an arc of a circle, extending along the entire length of the track 17 (and described in more detail below).

According to the preferred embodiment of this invention, there is a plurality of connecting modules 26 present, each interposed between the main supporting frame 2 and a labelling device 12.

Said connecting modules 26 are equipped with first coupling means 27 for allowing sliding coupling to the track 17, and second coupling means 28 for the reversible coupling of a labelling device 12 to the connecting module 26.

FIGS. 2 to 9 illustrate a first preferred embodiment of a connecting module 26. As can be seen, it comprises first a C-shaped plate 29 extending substantially along the oblique sides and the smaller base of a trapezium. Mounted on the plate 29 there are both the first coupling means 27 and the second coupling means 28 (the latter positioned at the end of the arms of the C). In practice, the plate 29 lies in a horizontal plane (perpendicular to the carrousel 6 axis of rotation) and the first and second coupling means 27, 28 extend upwards from it. Moreover, the plate is below the supporting surface 20 with the ends of the C projecting radially towards the labelling device 12.

According to the preferred embodiments, the first coupling means 27 usually comprise at least one roller 30 which can be connected to the track 17. Advantageously, for that purpose, the track 17 has at least a first concave or convex connecting surface 31, and the roller 30 has a second connecting surface 32 which is substantially shaped to match that of the track 17.

Whilst in some embodiments, not illustrated, the roller 30 (or the rollers 30) may rest on top of the track 17, in the case illustrated in the accompanying drawings the first coupling means 27 comprise at least two pairs 33 of opposite rollers 30, spaced out and positioned in such a way that each pair 33 can grip the track 17. As already indicated and as shown in FIG. 4, the track 17 is fixed to the rest of the main frame 2 by its upper face and has two first connecting surfaces 31 (the outer surface and the inner surface), whilst each roller 30 is rotatably mounted (idly in the accompanying drawings) on a rod 34 perpendicular to the plate 29, with its axis of rotation parallel with that of the carrousel 6. Moreover, advantageously, the rollers 30 of a connecting module 26 all lie in the same plane.

To mount each connecting module 26 on the track 17, in the embodiment illustrated there are two possibilities. With the first method the modules 26 can be connected to the track 17 by end insertion at least at one of the two ends 21, 22, positioning the module between the two ends of the track 17, with the rollers 30 aligned with it and making the module move along the track 17.

Alternatively, each module can be connected to the track 17 at any point by adjusting the distance between the rollers 30 of each pair 33. Advantageously, at least one roller 30 of each pair 33 can move relative to the other between a first, minimum distance position in which the two rollers 30 can retain the track 17 between them and a second, maximum distance position in which the track 17 can be inserted between the two rollers 30. In the preferred embodiment (not illustrated in detail) this is done by fixing the rod 34 to the plate 29 at a point which is eccentric relative to the axis of rotation of the respective roller 30, and rotating the rod 34 and the respective roller 30 relative to the fixing point.

In the preferred embodiment the second coupling means 28 comprise quick coupling means.

In the embodiment illustrated, in particular, the second coupling means 28 comprise the combination of at least one pin 35 and snap-on means 36 for coupling the pin 35, integral respectively with each other between the labelling device 12 and the connecting module 26. More particularly, each connecting module 26 comprises two sets of snap-on means 36 positioned on the radially projecting ends of the C formed by the plate 29, whilst each labelling device 12 comprises two vertical pins 35 whose axes of extension are parallel with the carrousel 6 axis of rotation.

Figure 10:
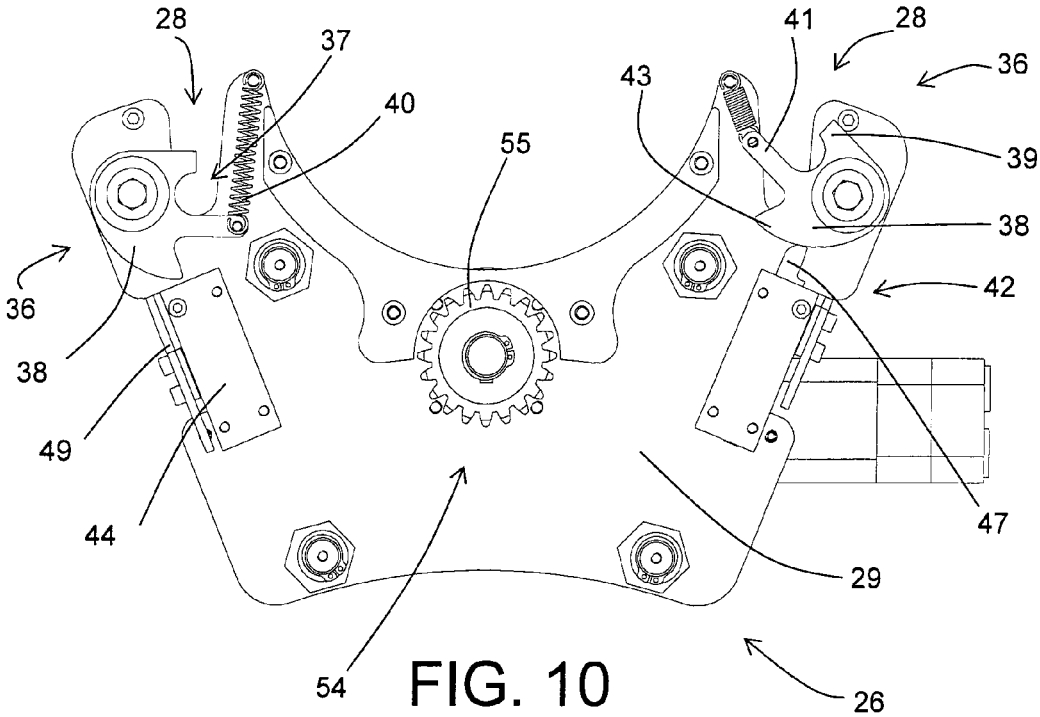
FIG. 10 shows the module of FIG. 7 with some parts cut away to better illustrate others.

In turn, as shown in FIG. 10, the snap-on means 36 comprise first a hole 37 for the pin 35 and at least one element 38 able to move between a first position in which it allows pin 35 insertion in the hole 37 and removal (right-hand element 38 in FIG. 10), and a second position in which it locks the pin 35 in the hole 37 (left-hand element 38 in FIG. 10). In the accompanying drawings the element 38 can move between the two positions by rotating about an axis parallel with that of the carrousel 6, and it comprises three shaped projections, a first projection 39 being for coupling the pin 35.

To keep the element 38 in the first position, in the absence of the pin 35, there are means 40 for returning the element 38 to the first position (elastic means in the accompanying drawings, comprising a spring connected between the plate 29 and a second projection 41 of the mobile element 38). In contrast, to keep the pin 35 in the hole 37 once inserted, there are means 42 for retaining the element 38 in the second position which interact with a third projection 43 of the element 38. The retaining means 42 comprise a containment block 44 having an open cavity 45 facing towards the element 38, in which a spring 46 and a sliding element 47 are inserted, the sliding element moving between a first position in which it projects from the containment block 44 and the spring 46 is extended, and a second position in which it is retracted inside the containment block 44 and the spring 46 is compressed. The spring 46 is also positioned in such a way that it drives (by pulling it) the sliding element 47 towards the element 38. To allow the pin 35 to be released, there are also means 48 for disabling the retaining means 42 which in the embodiments illustrated comprise a movement rod 49 connected to the sliding element 47 by a connecting element inserted in such a way that it passes through a slot 50 made between the cavity 45 of the containment block 44 and its outer surface, and which extends parallel with the direction of movement of the sliding element 47.

Figure 13:
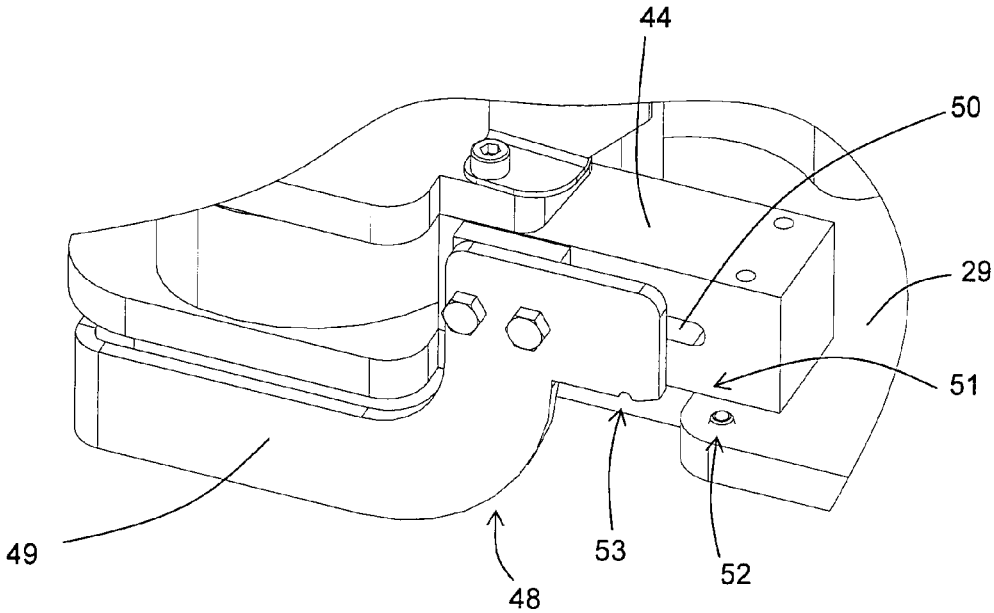
FIG. 13 is an enlarged view of a detail of the module of FIG. 12.
Figure 14:
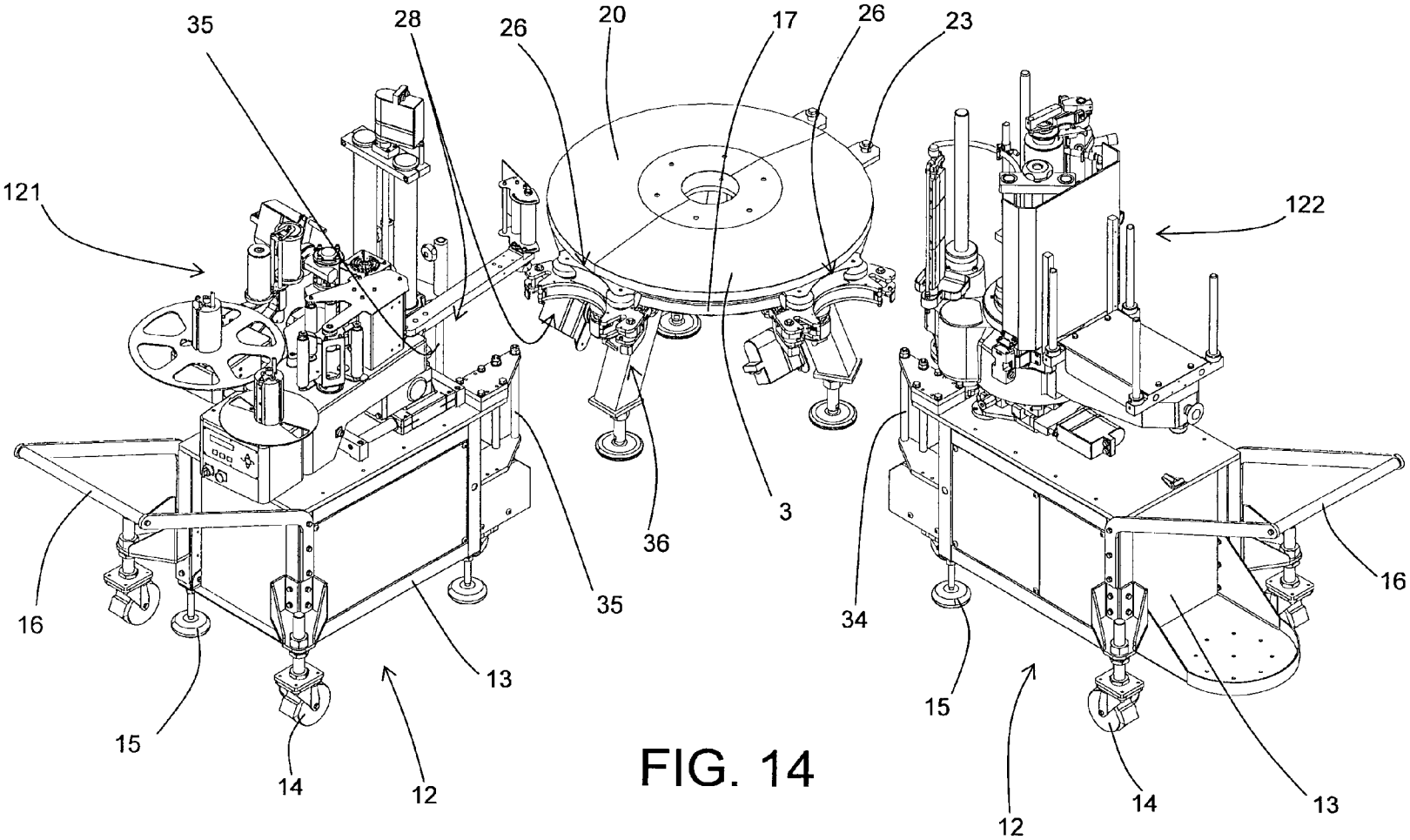
FIG. 14 shows the machine of FIG. 1 with some parts cut away and with the labelling devices detached from the main supporting frame.
Figure 15:
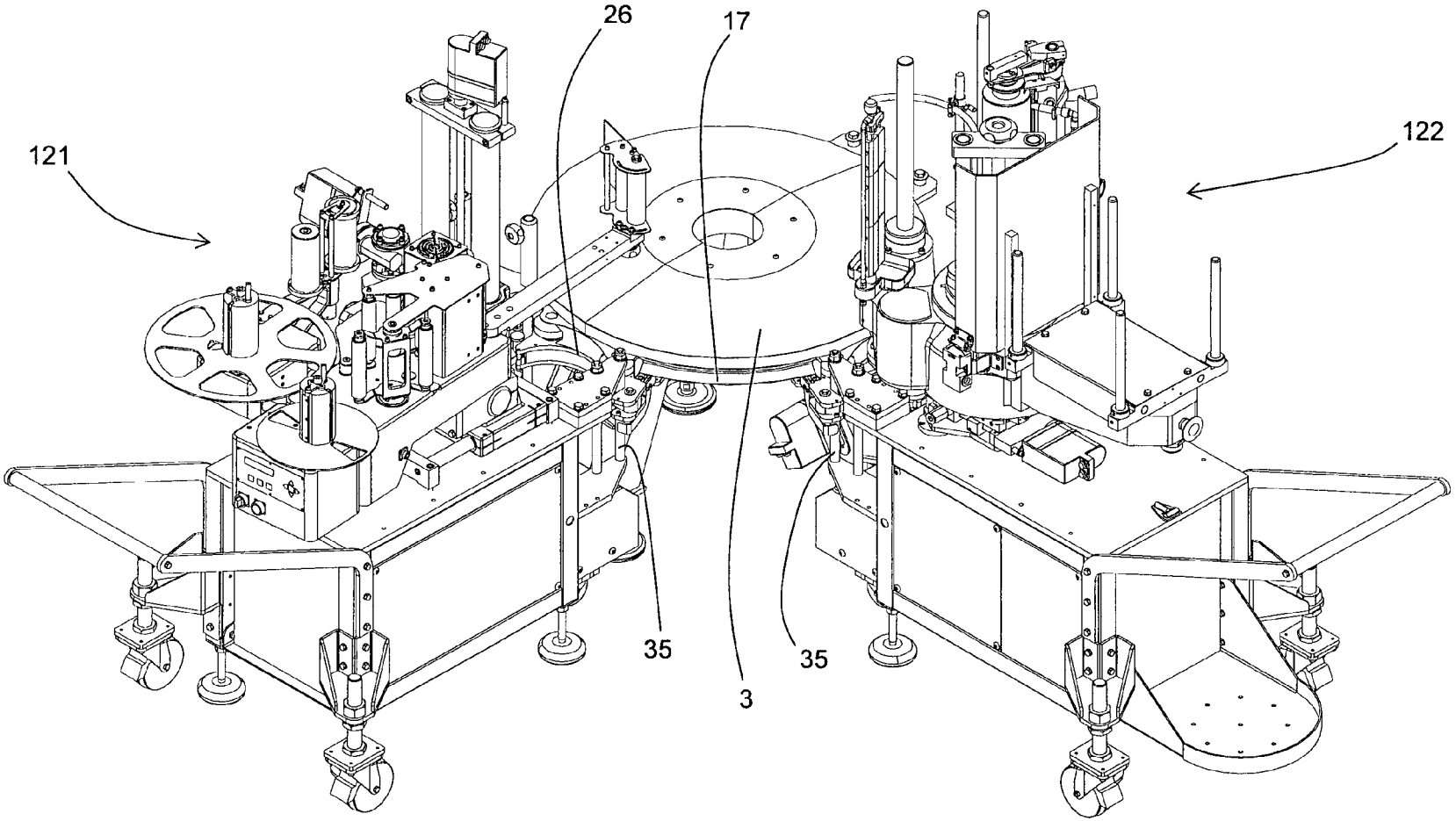
FIG. 15 shows the machine of FIG. 14 with the labelling devices connected to the main supporting frame.

Finally, to facilitate connection of the labelling device 12 to the connecting module 26, there are also locking means 51 for locking the sliding element 47 in the second position, freeing the movement of the coupling element 38. In the embodiment the locking means 51 comprise a bearing grub screw 52 which is elastically activated, mounted on the plate 29 and interacting with a recess 53 made in the movement rod 49 (FIG. 13).

According to an alternative embodiment and/or one complementing this invention, the machine comprises means 54 for the controlled movement of each labelling device 12 along the track 17.

Depending on requirements, the movement means 54 may be connected either to the connecting modules 26 or, in the absence of the latter, directly to the labelling devices 12 (which in such a case are directly slidably coupled to the track 17). Reference is made below mainly to the case illustrated in which there are connecting modules 26, although what is shown also applies for the other case (in which it is as if the connecting modules 26 were an integral part of the labelling devices 12).

Advantageously, the controlled movement means 54 comprise mechanical meshing between each labelling device 12 and the main frame 2, which, in the preferred embodiments illustrated, is achieved by interposing the connecting modules 26. The controlled movement means 54 comprise the rack 25 fixed to the main frame •2 and a gear wheel 55 rotatably connected to the connecting module 26 (in other embodiments the gear wheel 55 may be connected directly to a labelling device 12) and meshing with the rack 25.

Figure 11:
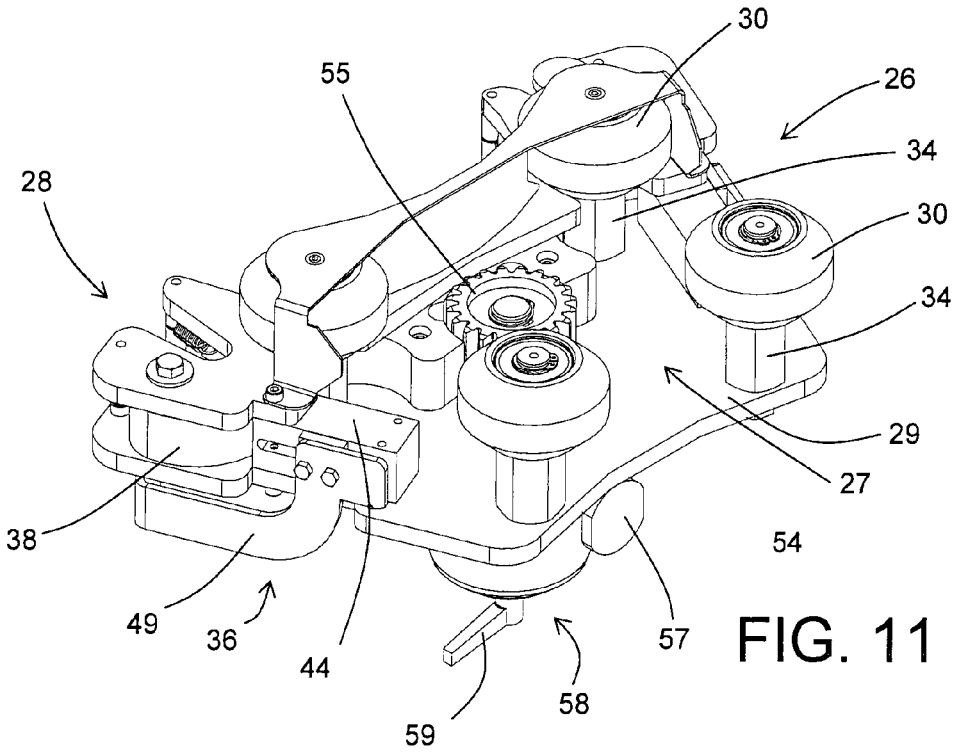
FIG. 11 is an axonometric view of a second embodiment of the connecting module.
Figure 12:
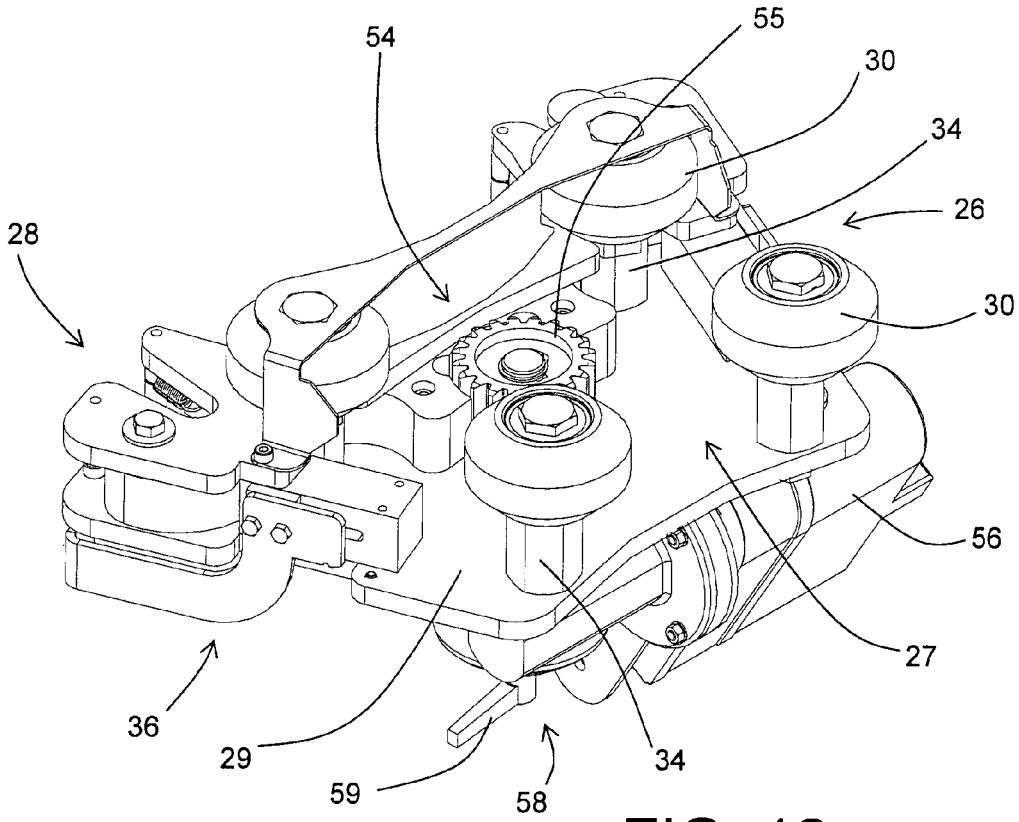
FIG. 12 is an axonometric view of a third embodiment of the connecting module.

Advantageously, there are also manual or motor-driven means connected to each connecting module 26 (or, more generally, to each labelling device 12) for making the gear wheel 55 rotate and consequently producing controlled movement of the device 12 along the track 17. In the embodiments shown in FIGS. 5 and 12 the controlled movement means 54 comprise a motor 56 connected to the gear wheel 55 (different types in the two figures), whilst in the embodiment in FIG. 11, the controlled movement means 54 are manual and comprise a knob 57 connected to the gear wheel 55 shaft to make it rotate. Moreover, in all of the embodiments illustrated, there are advantageously reversible fastening means 58 for selectively enabling and preventing the movement of each device along the track 17, advantageously acting on gear wheel 55 rotation. In the accompanying drawings they comprise a stop which is not visible, which can be operated using a special handle 59.

Moreover, in other embodiments not illustrated, the controlled movement means 54 may be incorporated in the first coupling means 27, for example by making the rack 25 coincide with the track 17 and the gear wheel 55 with at least one of the rollers 30.

Operation of the machine according to this invention derives immediately from the description of the structure above.

Initially, either as many connecting modules 26, if present, as there are labelling devices 12, or directly just the labelling devices 12 are slidably mounted on the track 17. Then, either using the movement means 54, or with simple sliding along the track 17, the connecting modules 26 or the labelling devices 12 are brought to the correct angular positions and fastened with the fastening means 58.

If connecting modules 26 are present, the labelling devices 12 are then fastened to the connecting modules 26 using the second coupling means 28. In particular, with the mobile elements in the first position, the device is moved forward against the supporting frame until the pins 35 make contact with the mobile elements. Another forward movement causes the pins 35 to be inserted in the holes and rotation of the mobile element 38 until it reaches the second position (achieved by pushing the sliding element 47 towards the second position). When the third projection 43 passes the sliding element 47, the latter return to its first position, locking the mobile element 38 and guaranteeing device fastening to the connecting module 26.

Finally, if necessary, the height of the labelling devices 12 relative to the carrousel 6 may be adjusted by acting on the height of the wheels 14 and of the feet 15.

In contrast, when a size change-over is required for the products to be labelled, if the labelling devices 12 are fastened to the connecting modules 26, to move them the operator can simply detach them from the connecting modules 26 by acting on the second coupling means 28 (and in particular freeing the mobile element 38 by means of the movement rod 49 which is brought into the position in which the bearing grub screw 52 interferes with the relative recess 53), move the connecting modules 26 to the desired position (by simply sliding them or using the movement means 54), then fasten the labelling devices 12 to the connecting modules 26 again.

In contrast, in the alternative embodiment which has no connecting modules 26, the devices are coupled directly to the track 17 and their position can be adjusted directly using the movement means 54, after disabling the fastening means 58.

This invention brings important advantages.

First, both of the embodiments proposed guarantee significant simplicity for precise positioning of the labelling devices along the edge of the carrousel, so that size change-overs can be performed very rapidly and precisely.

Second, both of the embodiments guarantee a high level of versatility for a relatively low cost, thanks to the fact that both the number of labelling devices and the machine dimensions can be minimised.

Moreover, whilst the embodiment which has no connecting modules is particularly suitable for devices with limited weight (which can be moved more easily by the movement means), the embodiment with the connecting modules is also excellent for moving heavy labelling devices.

It should also be noticed that the present invention is relatively easy to produce and that even the cost linked to implementing the invention is not very high.

The invention described above may be modified and adapted in several ways without thereby departing from the scope of the inventive concept.

Moreover, all details of the invention may be substituted with other technically equivalent elements and in practice all of the materials used, as well as the shapes and dimensions of the various components, may vary according to requirements.

The invention claimed is:

1. A labelling machine comprising:

a main supporting frame (2);

a carrousel (6) rotatably mounted on the main supporting frame (2) according to a vertical axis of rotation, the outside of the carrousel being equipped with a plurality of supporting means for the objects to be labelled;

means (9) for feeding the objects to be labelled to the supporting means and means (10) for picking up the labelled objects from the supporting means; and a plurality of labelling devices (12) positioned radially along the edge of the carrousel (6) which in practice apply labels to objects placed on the supporting means which pass them during carrousel (6) rotation;

the main supporting frame (2) having a guiding and supporting track (17) to which the labelling devices (12) are slidably connected so that they can be placed at different positions along the edge of the carrousel (6);

the machine being characterised in that it also comprises a plurality of connecting modules (26) equipped with first coupling means (27) allowing sliding coupling to the track (17), and also being characterised in that it also comprises second coupling means (28) for reversibly coupling each labelling device (12) to a connecting module (26);

characterised in that it also comprises means (54) for the controlled movement of each connecting module (26) along the track (17).

2. The labelling machine according to claim 1, characterised in that the controlled movement means (54) comprise mechanical meshing between each connecting module (26) and the main frame (2).

3. The labelling machine according to claim 2, characterised in that the controlled movement means (54) comprise a rack (25) fixed to the main frame (2), and a gear wheel (55) rotatably connected to each connecting module (26) and meshing with the rack (25).

4. The labelling machine according to claim 3, characterised in that it also comprises manual or motor-driven means mounted on each connecting module (26) for making the gear wheel (55) rotate and consequently moving the module along the track (17).

5. The labelling machine according to claim 3, characterised in that the rack (25) coincides with the track (17) and the gear wheel (55) of each connecting module (26) is part of the first coupling means (27).

6. The labelling machine according to claim 1, characterised in that it also comprises reversible fastening means (58) for selectively enabling and preventing the movement of each module along the track (17).

7. The labelling machine according to claim 1, characterised in that the first coupling means (27) comprise at least one roller (30) which can be connected to the track (17).

8. The labelling machine according to claim 7, characterised in that the first coupling means (27) comprise at least two pairs (33) of opposite rollers (30) which are spaced out, the rollers (30) of each pair (33) being able to grip the track (17) between them.

9. The labelling machine according to claim 8, characterised in that at least one roller (30) of each pair (33) can move relative to the other between a first, minimum distance position in which the two rollers (30) can retain the track (17) between them and a second, maximum distance position in which the track (17) can be inserted between the two rollers (30).

10. The labelling machine according to claim 7, characterised in that the rollers (30) have an axis of rotation which is substantially parallel with that of the carrousel (6) and they all lie in the same plane.

11. The labelling machine according to claim 7, characterised in that the track (17) has at least a first concave or convex connecting surface (31), each roller (30) having a second connecting surface (32) which is substantially shaped to match that of the track (17).

12. The labelling machine according to claim 1, characterised in that the second coupling means (28) comprise at least one pin (35) and snap-on means (36) for coupling the pin (35), being respectively integral with each other between the labelling device (12) and the connecting module (26).

13. The labelling machine according to claim 12, characterised in that the pin (35) has an axis of extension which is parallel with the carrousel (6) axis of rotation.

14. The labelling machine according to claim 12, characterised in that the snap-on means (36) comprise:

a hole (37) for the pin (35);

at least one element (38) able to move between a first position in which it allows pin (35) insertion in the hole (37) and its removal, and a second position in which it locks the pin (35) in the hole (37);

means (40) for retuning the element (38) towards the first position;

means (42) for retaining the element (38) in the second position; and means (48) for disabling the retaining means (42).

15. The labelling machine according to claim 1, characterised in that the second coupling means (28) are quick coupling means.

16. The labelling machine according to claim 1, characterised in that the track (17) has the shape of an arc of a circle.

17. The labelling machine according to claim 1, characterised in that the modules may be connected to the track (17) by end insertion at least at one end of the track.

18. The labelling machine according to claim 1, characterised in that the labelling devices (12) comprise a secondary supporting frame (13) equipped with wheels (14).

19. A labelling machine comprising:

a main supporting frame (2);

a carrousel (6) rotatably mounted on the main supporting frame (2) according to a vertical axis of rotation, the outside of the carrousel being equipped with a plurality of supporting means for the objects to be labelled;

means (9) for feeding the objects to be labelled to the supporting means and means (10) for picking up the labelled objects from the supporting means; and a plurality of labelling devices (12) positioned radially along the edge of the carrousel (6) which in practice apply labels to objects placed on the supporting means which pass them during carrousel (6) rotation;

the main supporting frame (2) having a guiding and supporting track (17) to which the labelling devices (12) are slidably connected so that they can be placed at different positions along the edge of the carrousel (6);

the machine being characterised in that it also comprises means (54) for the controlled movement of each labelling device (12) along the track (17).

20. The labelling machine according to claim 19, characterised in that the controlled movement means (54) comprise mechanical meshing between each labelling device (12) and the main frame (2).

21. The labelling machine according to claim 20, characterised in that the controlled movement means (54) comprise a rack (25) fixed to the main frame (2), and a gear wheel (55) rotatably connected to each labelling device (12) and meshing with the rack (25).

22. The labelling machine according to claim 21, characterised in that it also comprises manual or motor-driven means connected to each labelling device (12) for making the gear wheel (55) rotate and consequently moving the device along the track (17).

23. The labelling machine according to claim 21, characterised in that the rack (25) coincides with the track (17).

24. The labelling machine according to claim 19, characterised in that it also comprises reversible fastening means (58) for selectively enabling and preventing the movement of each labelling device (12) along the track (17).

* * * * *